US006699581B2

(12) United States Patent
Yotsutsuji et al.

(10) Patent No.: US 6,699,581 B2
(45) Date of Patent: Mar. 2, 2004

(54) BIODEGRADABLE FIBERS AND FABRICS, AND METHOD FOR CONTROLLING THEIR BIODEGRADABILITY

(75) Inventors: Susumu Yotsutsuji, Osaka (JP); Yoshiyuki Andou, Kurashiki (JP); Akihiro Hokimoto, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 10/293,305

(22) Filed: Nov. 14, 2002

(65) Prior Publication Data

US 2003/0092338 A1 May 15, 2003

(30) Foreign Application Priority Data

Nov. 14, 2001 (JP) ..... 2001-348141

(51) Int. Cl.[7] ..... D01F 6/00

(52) U.S. Cl. ..... 428/364; 428/395; 428/398; 428/400

(58) Field of Search ..... 428/364, 395, 428/373, 400, 397, 398

(56) References Cited

U.S. PATENT DOCUMENTS 5,593,778 A * 1/1997 Kondo et al. ..... 428/373

FOREIGN PATENT DOCUMENTS

JP 02001226821 A * 8/2001

OTHER PUBLICATIONS

Patent Abstracts of Japan, JP 11–293519, Oct. 26, 1999.

Patent Abstracts of Japan, JP 08–302526, Nov. 19, 1996.

X. Yuan, et al., Polymer Degradation and Stability, vol. 75, No. 1, pp. 45–53, XP–004326574, "Comparative Observation of Accelerated Degradation of Poly(L–Lactic Acid) Fibres in Phosphate Buffered Saline and a Dilute Alkaline Solution", 2002.

* cited by examiner

*Primary Examiner*—N. Edwards
(74) *Attorney, Agent, or Firm*—Oblon, Spivak, McClelland, Maier & Neustadt, P.C.

(57) ABSTRACT

Biodegradable fibers of polylactic acid having a number-average molecular weight of from 50,000 to 150,000, have an interior portion having a higher alkali solubility than the exterior portion of the fiber. The fibers also have from 5 to 50 cracks/10 cm. The physical properties of these fibers are suitable for practical use, and the biodegradation of these fibers is controllable.

19 Claims, 2 Drawing Sheets photograph substitute for drawing photograph substitute for drawing photograph substitute for drawing photograph substitute for drawing

BIODEGRADABLE FIBERS AND FABRICS, AND METHOD FOR CONTROLLING THEIR BIODEGRADABILITY

BACKGROUND OF THE INVENTION

1. Field of the Invention

The present invention relates to biodegradable fibers. More precisely, the invention relates to biodegradable fibers of polylactic acid that provide biodegradable plastics which are more environmentally acceptable than conventional plastics, and which have a controllable rate of biodegradation which varies depending upon how the fibers are used.

2. Discussion of the Background

Polylactic acid is one of the recyclable plastics presently recognized as having good environmental qualities. Polylactic acid fibers made from polylactic acid are expected to be commercialized as biodegradable fibers that are environmentally "friendly" and ecologically favorable.

In order to become commercially acceptable, biodegradable fibers must a level of mechanical strength which is at least that of conventional fibers such as polyester fibers. Specifically, biodegradable fibers are not commercially acceptable if they biodegrade during ordinary use. Accordingly, various proposals have been made relating to the production and the physical properties of biodegradable fibers which have commercially acceptable properties.

For example, one method proposed for efficiently producing polylactic acid fibers having stable physical properties comprises melt-spinning polylactic acid fibers, cooling and solidifying the fibers, then re-heating and exposing the heated fibers to a stream of air. It is claimed that this method promotes the orientation and the crystallization of the fiber-forming polymer, and provides fibers having high levels of mechanical strength and elasticity, which are not provided by any ordinary high-speed fiber-spinning and drawing method (for example, see JP-A-11-131323, paragraph 0016 and FIG. 1).

Another method proposed for producing polylactic acid fibers comprises using a hydrolysis-resistant polymer having a reduced amount of low-molecular weight compounds, in order to stabilize the fibers in the natural environment, especially in water or under humid conditions (for example, see JP-A-7-316272, paragraph 0002, lines 1 to 5, and paragraph 0005; and JP-A-9-21018 paragraphs 0006 and 0007).

These methods are intended to retard the biodegradation of the fibers while in use, but they do not promote the biodegradation of the fibers after use, and do not control or retard the rate of biodegradation of the fibers while in use. In addition, the biodegradability of the fibers and nonwoven fabrics made from these fibers is such that they may lose their strength in a period of from a half year to one year after they are buried in the ground. This means that fibrous wastes of this type require a long period of time (i.e., on the order of a year) before such buried wastes are biodegraded. Accordingly, such fibers and fabrics are unsuitable for land reclamation. On the other hand, incinerating such fibers and fabrics is undesirable because it may promote global warming.

The comparative examples of the biodegradation-retarding methods shown in various patent publications provide some examples of biodegradation-promoting methods, but do not describe methods of controlling biodegradation—that is, ensure the stability of biodegradable fibers while in use and rapidly biodegrade the used fibers after disposal.

Various methods of promoting and controlling the biodegradation of articles have been investigated (for example, see JP-A-9-263700, paragraph number 0011). This method comprises adding from 10 to 40% by weight of dry coconut powder to a polymer followed by shaping the mixture into articles. When articles produced by this method are buried in the ground after use, the dry coconut powder absorbs water in the ground, and the buried articles are thereby swollen and biodegraded. This method is unique in that it provides biodegradation control of buried articles. However, the size of the particles of coconut powder mixed with the polymer is large, from 20 to 80 $\mu$m. Thus, this method is not suitable for fibers having a diameter of only from 14 to 30 $\mu$m.

Fibers having a core-sheath structure, composed of polymers having different biodegradability, or fibers having a notched surface structure composed of different polymers have been proposed (for example, see JP-A-9-78427, paragraph number 0014 and Japanese Patent No. 3,304,237, paragraph number 0006). These fibers have a polymer of lower biodegradability supporting another polymer of higher biodegradability, thereby preventing the fibers from deteriorating while in use. However, the biodegradation of the polymer of higher biodegradability varies depending on the surrounding conditions, and therefore the biodegradation of the fibers themselves varies depending on the surrounding conditions. Thus, the biodegradation of the fibers cannot be controlled independently of the conditions surrounding the fibers. Accordingly, the life of products made from such fibers varies depending on the environment in which they are used, and the biodegradation of such fibrous products is not promoted at all after disposal. In other words, this method does not provide control of the biodegradation of the fibers.

Similarly to the present invention, a method of notching the surfaces of fibers has been proposed. This method comprises thermally stretching fibers to a draw ratio not lower than the maximum draw ratio, to thereby form uniform voids inside the fibers. In addition, the surfaces of the stretched fibers have streaky notches (see JP-A-11-293519, paragraph 0013, and photographs). However, these fibers take a long time, approximately 18 months, before they are actually biodegraded, as shown by the examples provided in this patent publication, and this method of biodegradability control does not conform to conventional practices of processing and biodegrading used fibers.

The biodegradable fibers that are most preferred for commercial use are those that maintain their strength while in actual use, but can rapidly degrade after use and disposal, or those having controllable biodegradability. Up to the present, however, no one has proposed controlling biodegradation, or provided biodegradable fibers based on controlling biodegradation.

SUMMARY OF THE INVENTION

The present invention solves the problems noted above and provides biodegradable fibers having physical properties suitable for practical use, and permits the time of biodegradation to be controlled in any desired manner.

The present inventors have found that, when fibers are designed to have a specific structure or when a fiber-processing agent is applied to the fibers, then the biodegradation of the fibers is retarded or promoted. Specifically, cracks are formed in the surface of the fibers so that the strength of the fibers is sufficient for ordinary practical use.

On the other hand, when used articles comprising the fibers are disposed of, or formed into compost, the fibers are actively biodegraded after a specific processing agent is applied thereto. Accordingly it is possible to easily control the biodegradation of the fibers in any desired manner. The present invention provides biodegradable fibers of polylactic acid having a number-average molecular weight of from 50,000 to 150,000, wherein the alkali solubility of the inside part of each fiber is greater than that of the outer, peripheral portion of the fiber, and the surface of each fiber has from 5 to 50 cracks/10 cm.

Preferably, a fiber-processing agent having a pH of less than 7.8 is applied to the biodegradable fibers.

Also preferably, a fiber-processing agent (a), having a strength reduction-promoting constant (KR value) represented by the following formula (1) of less than 1.2, is applied to the biodegradable fibers.

$$\text{Strength Reduction-promoting Constant}(KR\text{ value})=TA/TB \quad (1)$$

TA is the strength of fibers of polylactic acid having a number-average molecular weight of from 50,000 to 150,000, the fibers being prepared so that the alkali solubility of the inside portion (i.e., the core) of each fiber is greater than that of the outer, peripheral portion (i.e., the skin) of the fiber, and the surface of each fiber has from 5 to 50 cracks/10 cm. The strength of such fibers is measured after the fibers are degreased and then left at a temperature of 50° C. and a humidity of 65% for 7 days.

TB is the strength of fibers of polylactic acid having a number-average molecular weight of from 50,000 to 150,000, the fibers being prepared so that the alkali solubility of the inside portion of each fiber is larger than that of the outer peripheral portion of the fibers, and the surface of each fiber has from 5 to 50 cracks/10 cm. The strength is measured after the fibers are degreased, from 1 to 5% by weight of the fiber-processing agent (a) is applied to the fibers held under a tension of from 0.05 to 0.20 g/dtex, and then the thus-processed fibers are left at a temperature of 50° C. and a humidity of 65% for 7 days.

The invention also provides a method of controlling the biodegradation of the fibers and promoting the biodegradation of the biodegradable fibers, comprising treating the surfaces of the fibers with an alkaline fiber-processing agent having a pH of not lower than 7.8.

Preferably the fiber-processing agent (b) has a strength reduction-promoting constant (KR value), represented by formula (1) above, of at least 1.2, and is applied to the biodegradable fibers to promote the biodegradation of the fibers.

Also preferably, a processing agent that contains at least 1% by weight of at least one component selected from a group consisting of polyoxyethylene phosphates, phosphate salts, phosphate amines and oleic acids may be applied to the biodegradable fibers in order to promote the biodegradation of the fibers.

The present invention also provides a fabric formed from the biodegradable fibers.

DETAILED DESCRIPTION OF THE PREFERRED EMBODIMENTS

Figure 1:
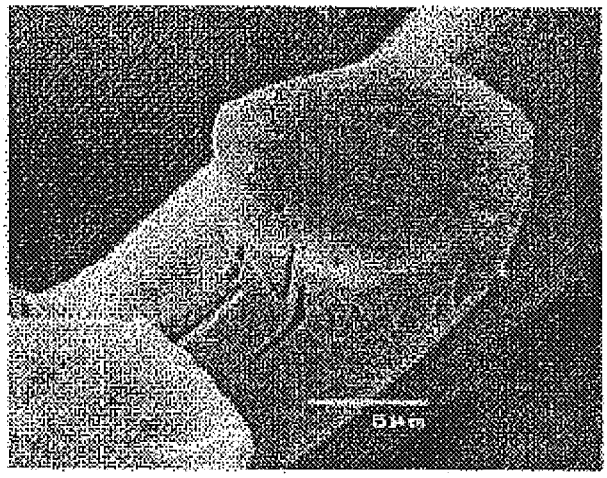
FIG. 1 is a photograph that shows a cross-section of the fiber morphology of the biodegradable fibers of the present invention before processing with an alkaline solution.

The present invention is described in detail below.

It is important that the polylactic acid of the biodegradable fibers of the present invention comprises a polymer having a number-average molecular weight of from 50,000 to 150,000. Polylactic acid having a number-average molecular weight of less than 50,000 provides fibers having a strength which is too low for practical use. In addition, the surfaces of fibers formed from polylactic acid having a number-average molecular weight of less than 50,000 could not be suitably cracked when subjected to external forces during drawing, crimping or false-twisting. In contrast, polylactic acid having a number-average molecular weight greater than 150,000 could not be easily spun into fibers since it has poor flowability. This is because the melt viscosity of a polylactic acid polymer having a number-average molecular weight greater than 150,000 is high, and when the polymer is run through spinning ducts, it must be heated to a high temperature (i.e., the melting point of +80° C.). If not heated to a high temperature, the pressure loss increases, and the polymer could not flow through the ducts. However, when polylactic acid is heated to such a high temperature, it pyrolyzes to a significant extent, thereby forming oligomers. The resulting oligomers soil the spinning nozzles and cause various spinning problems. For example, the fibers of the polymer often break and are fluffed significantly during spinning. For these reasons, polylactic acid having a number-average molecular weight greater than 150,000 has poor properties. In order to provide suitable physical properties and good spinnability, the number-average molecular weight of the polylactic acid of the fibers preferably falls between 60,000 and 120,000, more preferably between 70,000 and 110,000.

The polylactic acid of the present invention consists essentially of a copolymer of optical isomers of L-lactic acid and D-lactic acid, of which, poly-L-lactic acid is generally used in the art.

Preferably, the poly-L-lactic acid used in the method of the present invention has an optical purity of from 90.0 to 99.5%. Increasing the content of the other optical isomer, D-lactic acid, in the polymer may lower the crystallinity and the melting point of the polymer, thereby reducing the heat resistance of the fibers of the polymer. On the other hand, however, decreasing the D-lactic acid content of the polymer too much may reduce the biodegradability of the fibers of the polymer. In general, fibers for ordinary use must be heat resistant. It is therefore desirable that the optical purity of the poly-L-lactic acid falls between 96.0 and 99.5%. Binder fibers must have a low melting point. It is desirable that the optical purity of the polymer for binder fibers falls between 90.0 and 96.0%.

Any other resin and additive may be added to the polymer of the present invention, as long as it does not interfere with the advantageous properties of the polymer.

The fibers of the present invention must have a fiber structure such that the alkali solubility of the inside portion of each fiber is greater than that of the outer, peripheral portion of the fiber. The fiber structure of the fibers of the present invention is designed so that the outer portion (surface portion) is resistant to hydrolysis, but the inside portion (the portion nearer to the center of the fiber) is not resistant to hydrolysis.

In the polylactic acid fibers of the present invention, it is desirable that highest molecular weight component of the polymer is first hydrolyzed to a molecular weight or molecular size which is capable of being degraded by enzymes, and then is biodegraded enzymatically. If the fibers are completely resistant to hydrolysis, they are poorly biodegraded, and therefore the biodegradation cannot be controlled, as in the present invention. In addition, as described below, the biodegradation control method of the present invention cannot be used with fibers in which the inside portion of each fiber is first hydrolyzed to initiate the fiber biodegradation.

In order to promote the hydrolysis of the fibers, the fibers may be exposed to a high-temperature and high-humidity environment, or they may be sprayed with a strong alkaline solution. However, this method of exposing fibers to a high-temperature and high-humidity environment is environmentally undesirable. This method requires that the used products be collected and transported to a place where they can be exposed to high temperature and high humidity. Thus, this method is troublesome, and the collection, transport, and treatment of the used products have an undesirable, negative environmental impact. The alternative method of spraying strong alkali on used fibrous products is effective for promoting fiber hydrolysis, but is undesirable because an alkali which is strong enough to promote fiber hydrolysis, kills biodegrading enzymes that are not resistant to alkali, and therefore retards the biodegradation of the fibrous products sprayed with alkali. In addition, such a method spraying alkali is environmentally undesirable.

In contrast to the above methods, if the total biodegradability of fibers is too high, the strength of the fibers will decrease while in use, and therefore the fibers would be unacceptable for practical use. Therefore, fibers of this type are also undesirable.

In order for biodegradable fibers to satisfy the requirements of the present invention, that the fibers maintain their strength while in use, and biodegrade after use and disposal, it is important that the fibers are so designed that the alkali solubility of the inside portion of each fiber is greater than that of the outer, peripheral portion.

In addition, it is also important that the biodegradable fibers of the present invention have cracks in their surfaces. Cracks in the surface of the fibers make it possible to control the biodegradability of the fibers—that is, to control the biodegradation rate of the fibers while maintaining the strength of the fibers sufficiently for practical use. The cracks in the surface of the fibers may run in various directions, including in the direction of the fiber axis and in a direction perpendicular to the fiber axis. Cracks running in a direction perpendicular to the fiber axis preferably have a mean length of from 1/40 to 2/3 of the thickness of the outer periphery that surrounds the cross section of each fiber. If the mean length of the cracks is larger than 2/3 of the outer periphery, the fiber strength will be low, and fibers having such long cracks will be unsuitable for practical use if the long cracks are too deep. The cracks running in the direction of the fiber axis may have different lengths. Preferably, their length falls between 1/20 and 3 times the fiber diameter in order that the fibers may have the necessary strength. Also preferably, the depth of each crack running inside the fibers falls between 3 and 30% of the fiber diameter. If the crack depth is smaller than 3% of the fiber diameter, the fiber-processing agent applied to the fibers may not sufficiently penetrate into the depth of each fiber, where the alkali solubility is higher, and the biodegradability of the fibers will not be properly controlled. On the contrary, if the crack depth is larger than 30% of the fiber diameter, the strength of the fibers will be low, and fibers having such deep cracks will be unsuitable for practical use if the deep cracks are too long.

The cracks serve as capillaries through which a fiber-processing agent may enter the fibers. The fiber-processing agent assists the propagation of biodegrading enzymes into the fibers, thereby promoting the biodegradation of the fibers, as described below. Fibers of the present invention, having cracks, differ fundamentally from other fibers having notched surfaces, because the fibers of the present invention have a dry feel. Another advantage of the method and fibers of the present invention is that the biodegradation of the fibers may be promoted or retarded in accordance with the intended use of the fibers, by means of the type of processing agent applied to the fibers.

It is also important that the surface of each fiber of the invention has from 5 to 50 cracks/10 cm. Preferably, the fiber surface has from 8 to 40 cracks/10 cm, more preferably from 10 to 30 cracks/10 cm. If the number of cracks in the fiber surface is less than 5 cracks/10 cm, the biodegradation of the fibers is not promoted sufficiently, even when the fibers are processed with a fiber-processing agent. On the other hand, if the number of the cracks in the fiber surface is greater than 50 cracks/10 cm, the fiber strength will be too low, or the fibers will become too weak while in use. Such fibers are therefore unsuitable for practical use. The number of cracks in the fiber surface may be counted by observing the fibers with a scanning electronic microscope (SEM).

Figure 2:
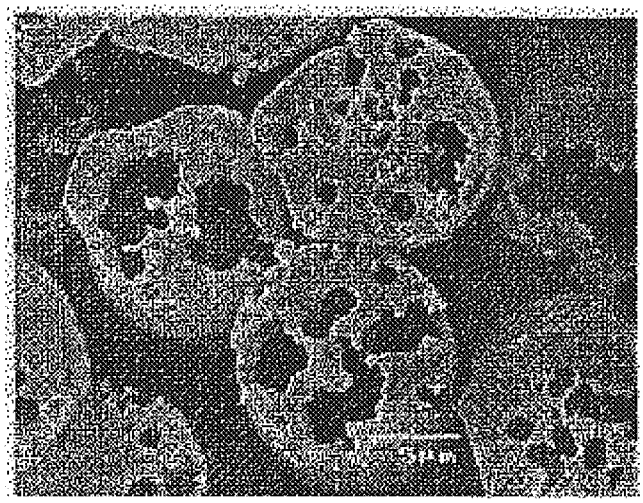
FIG. 2 is a photograph that shows a cross-section of the fiber morphology of the biodegradable fibers of the present invention after processing with an alkaline solution.

The structure of the cross-section of the fibers of the present invention, which are prepared so that the alkali solubility of the inside portion of each fiber is greater than that of the outer, peripheral portion, is shown in FIG. 1 and FIG. 2. FIG. 1 shows fibers before they are processed for alkali dissolution. FIG. 2 shows fibers after they are processed with an aqueous 1 N alkali solution at 50° C. for 15 minutes. The fibers of FIG. 2 have an outer skin (i.e., the outside of each fiber) which remains essentially intact, while the inside of the fiber (inner part of each fiber) is eroded. This is because the fibers are prepared so that the alkali solubility of the outer, peripheral portion in the cross-section of each fiber is low, while that of the inside portion, that is, the inner portion, is high. The fiber structure morphology of FIG. 2, provided by the alkali dissolution treatment described above, is due to the inside portion of the fiber having a higher level of alkali dissolution than the outer, peripheral portion of the fiber.

Depending on the alkali dissolution treatment conditions, the cross-section of the fiber may have a porous structure due to the partial dissolution of the shell, or because the inside portion of the fiber is slowly decomposed and dissolved. This is because the polylactic acid polymer forming the fibers is extremely rapidly hydrolyzed with alkali and it is therefore difficult to uniformly dissolve the polymer. In addition, the fibers dissolve in alkali at different rates.

In view of the above, the fibers of the present invention, in which the inside portion has a rate of alkali dissolution which is higher than the outer peripheral portion, are defined as follows. When filaments made of such fibers are dissolved in alkali, at least 50% of the total number of the fibers of the filaments each have from 10% to 95% of voids formed inside them.

Preferably, the shell (exterior portion) of the cross section of each fiber of the present invention, having a rate of alkali dissolution in the inside portion which is greater than that of the outer, peripheral portion, has a thickness of from 5 to 20% of the mean diameter of the fibers, more preferably from 10 to 20% thereof. If the shell thickness is less than 5% of the mean diameter of the fibers, the strength of the fibers will decrease over time, even though the fibers are not subjected to a biodegradation-promoting treatment. On the other hand, if the shell thickness is greater than 20%, a processing agent can not easily penetrate into the inside portion of the fibers, even though the surface of the fiber is cracked. As a result, the fibers of this type may not be suitably biodegraded.

If the fibers of the present invention are processed with an aqueous alkali solution of higher concentration, at higher temperatures, and for a longer period of time than described above, the fibers will be entirely dissolved. If so, no one could confirm the specific fiber structure of the present invention, in which the alkali solubility of the inside portion of each fiber is greater than that of the outer, peripheral portion of the fiber. Therefore, special attention should be paid to the conditions of the alkali dissolution treatment of the fibers of the present invention.

In order to provide a fiber structure having an alkali solubility of the inside portion of each fiber which is greater than that of the outer, peripheral portion, and in which each fiber surface has cracks, a rigid polymer having a number-average molecular weight of at least 50,000 must be used in forming the fibers. Preferably, the draw ratio of the spun fibers falls between 85% and 120% of the elongation at break of the fibers, measured at room temperature (25° C.). If the draw ratio of the fibers is less than 85%, the fibers may not have the intended fiber structure (i.e., wherein the alkali solubility of the inside portion of each fiber is greater than that of the outer, peripheral portion). In addition, it will be difficult to form voids inside each fiber, and therefore the fibers may not have cracked surfaces. On the other hand, if the draw ratio of the fibers is greater than 120%, too many voids will be formed inside each fiber, and the fibers will break and be fluffed too much during formation. As a result, the productivity of the fiber forming process will be lower and, in addition, the fiber strength will be low.

In this regard, ordinary polyester fibers will break and be fluffed too much when drawn to a draw ratio of at least 85% of the elongation at break, and the productivity of this process will therefore be low. In contrast, however, the polylactic acid fibers of the present invention hardly ever break, even when drawn to the high draw ratio described above. The present inventors have found that the ratio of the draw ratio of polylactic acid fibers to the elongation at break varies greatly, depending on the atmospheric temperature at which the fibers are drawn (in case of dry heat drawing, this temperature is the temperature of the heated roller used for drawing the fibers). Experiments show that the ratio of the draw ratio to the elongation at break of high-speed spun raw fibers of polylactic acid (hereinafter referred to as POY raw fibers) that are wound up at a winding speed of 3000 m/min and drawn at an atmospheric temperature of 110° C., is 1.15, compared to the fibers of JP-A-11-131323, which are drawn at an atmospheric temperature of 60° C. at the same winding speed. The ratio of the draw ratio to the elongation at break of POY raw fibers drawn at an atmospheric temperature of 120° C., at the same winding speed, greatly increases to 1.40 or more. When the polymers of polylactic acid having a number-average molecular weight of from 50,000 to 150,000 are drawn at a high atmospheric temperature to a ratio of the draw ratio to the elongation at break at room temperature (25° C.), the surface of each fiber is highly drawn because the surface temperature of the fiber is high. However, the inside of the fiber is barely drawn, because the interior temperature of the fiber is lower than that of the outer surface. This provides a draw ratio difference between the inside and the outer surface of each fiber. The draw ratio difference leads to the alkali solubility profile of the fibers of the present invention, in which the alkali solubility of the inside portion of each fiber is greater than that of the outer, peripheral portion. When fibers are drawn to the same draw ratio, those in which the temperature of the heated roller is lower have more strain, as described below. Fibers drawn at higher temperatures may have the specific fiber structure of the present invention, in which the alkali solubility of the inside portion of each fiber is greater than that of the outer, peripheral portion, and therefore may have more strain to form more cracks in their surfaces. Accordingly, the temperature of the heated roller to be used for drawing the biodegradable fibers of the present invention, under dry heat, preferably falls between 50 and 140° C., depending on the drawing rate. If the drawing temperature is lower than 50° C., it is lower than the glass transition temperature of the polymer, and the drawing mode at such a low temperature is cold drawing. Cold drawing provides too many cracks on the fiber surface, and the fiber productivity is low, and is therefore unsuitable method for forming fibers according to the present invention. On the other hand, however, if the drawing temperature is higher than 140° C., fibers drawn at such a high temperature will move therefore break and become fluffed. The productivity of such a process will therefore be low. If the fibers are drawn under wet heat, the temperature of the drawing bath preferably falls between 50 and 95° C. If the bath temperature is lower than 50° C., it is lower than the glass transition temperature of the polymer forming the fibers, and the drawing mode at such a low temperature is cold drawing, as in the case of dry heat drawing. Cold drawing under these conditions is also unsuitable for preparing fibers according to the present invention, because too many cracks form in the fiber surface, and the fiber productivity is low. The uppermost limit of the temperature when the fibers are mass-produced by wet heat drawing is 95° C., since the drawing bath comprises water.

Figure 3:
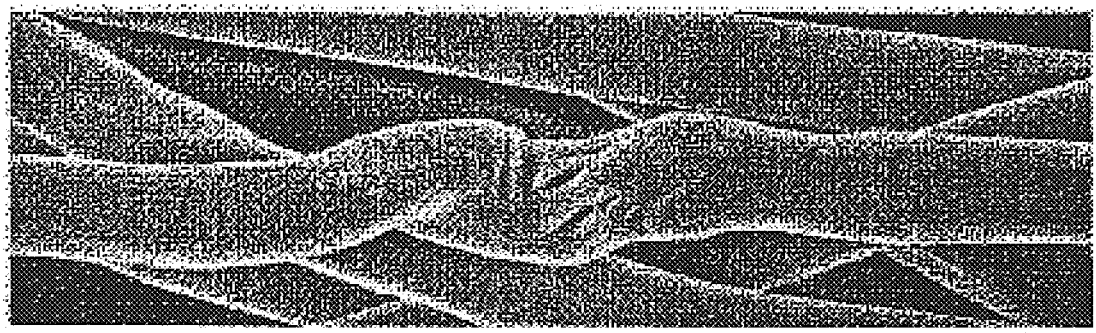
FIG. 3 is a side-view photograph of the biodegradable fibers of the present invention.
Figure 4:
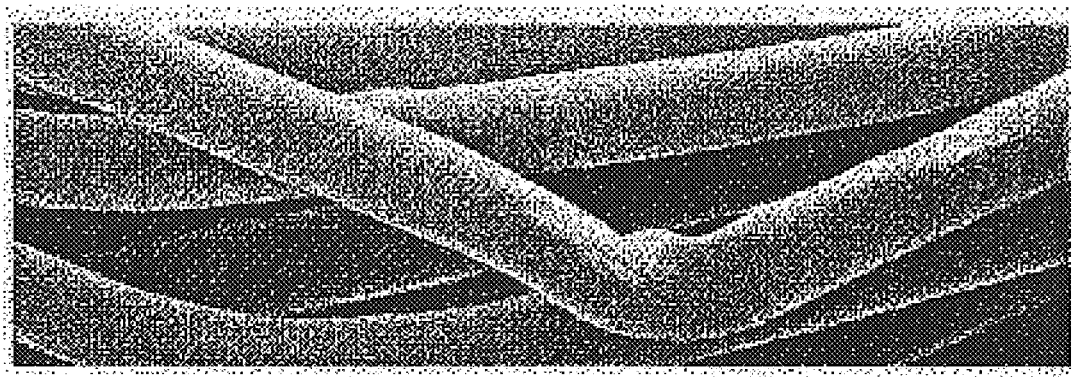
FIG. 4 is a side-view photograph of conventional biodegradable fibers.

A side-view of the biodegradable fibers of the present invention is shown in FIG. 3, and conventional biodegradable fibers are shown in FIG. 4. In FIG. 3, many cracks are present in the side surfaces of the fibers of the present invention, but no cracks are present in the side surfaces of the conventional biodegradable fibers in FIG. 4.

The mechanism of forming cracks must be taken into consideration. The present inventors have found that crack formation correlates to the number-average molecular weight of the polylactic acid comprising the fibers, and to the voids formed inside each fiber. In general, the specific gravity of thermoplastic fibers increases with an increase in the crystallinity of the highly drawn fibers. In contrast, when the polylactic acid fibers of the present invention are highly drawn, the drawing strain is retained inside the fibers, and therefore the fibers have minute cavities, so-called voids, inside. The specific gravity of drawn fibers is 0.95 or less relative to that of the non-drawn raw fibers of JP-A-11-131323, which indicates the formation of voids inside the drawn fibers. After formation, the voids are cleaved by an external force applied thereto, and provide cracks. That is, the voids formed in short fibers are cleaved by an external force applied thereto, for example, in a forced crimping step or in a spinning step, providing cracks. Voids formed in long fibers are cleaved by an external force applied thereto, for example, in a false-twisting or pneumatic processing step, to provide cracks. Accordingly, the fibers of the present invention have many cracks where the fibers are bend, and in which the external force applied thereto concentrates.

It is desirable that the crimping conditions for forming cracks in the surfaces of the fibers is carried out under conditions in which the pressure at the inlet of the crimper falls between 2.0 and 6.0 kg/cm$^2$, the pressure at the outlet of the crimper falls between 2.0 and 5.5 kg/cm$^2$, and the crimping rate falls between 60 and 150 m/min. More preferably, the pressure at the inlet of the crimper falls between 2.5 and 3.5 kg/cm$^2$, the pressure at the outlet falls between 2.0 and 3.5 kg/cm$^2$, and the crimping rate falls between 60 and 100 m/min. If the pressure at the inlet and that at the outlet of the crimper are over 6.0 kg/cm$^2$ or 5.5 kg/cm$^2$, respectively, too many cracks will be formed and the physical properties of the fibers will therefore be poor, and the fibers may break. On the other hand, if the pressure at the inlet and that at the outlet of the crimper are lower than 2.0 kg/cm$^2$, the number of cracks formed will be too low, and the biodegradability of the fibers will be difficult to control. The preheating temperature of the fibers before crimping preferably falls between 55 and 75° C. If the preheating temperature is lower than 55° C., the fibers will be difficult to crimp and the number of cracks formed will be reduced, and the biodegradability of the fibers will be difficult to control. On the other hand, preheating temperatures higher than 75° C. are unsuitable, since at that temperature the fibers will aggregate with each other. A friction-type false twister is preferred to a pin-type false twister. Although it may depend on the type of the spinning oil used, polylactic acid fibers generally have high friction resistance and their untwisting tension tends to increase. In pin false-twisting, the ratio of untwisting tension/twisting tension of polylactic acid fibers falls between 3 and 5, and is about 1.5 to 2.5 times that of ordinary polyester fibers. Therefore, when false-twisted in a pin-type false twister, polylactic acid fibers will be significantly fluffed and have more than 50 cracks/10 cm in their surfaces. Also in a friction-type false twister, polylactic acid fibers have a high untwisting tension—1.1 to 1.3 times that of ordinary polyester fibers. In addition, the friction false-twisting of polylactic acid fibers prevents them from becoming too fluffed and cracked. For these reasons, a friction-type false twister is preferred to pin-type false twister for false-twisting polylactic acid fibers. It is desirable that the false twisting be carried out under conditions in which the heater temperature is 160° C. or less, and the count of false twists of the fibers falls between 2000 and 2500 twists/m in fibers of 167 dtex. More preferably, the heater temperature may fall between 120 and 150° C., and the count of false twists of the fibers falls between 2200 and 2400 twists/m in fibers of 167 dtex. If the heater temperature is higher than 160° C., the fibers will aggregate with each other, and too many cracks will form in their surfaces. Therefore, the physical properties of such fibers will be not good. On the other hand, if the heater temperature is lower than 120° C., the fibers will be poorly false-twisted and have poor quality. If the count of false twists of the fibers is more than 2500 twists/m, the fibers will be fluffed too much, and will often break, and the productivity of this process will be lower. In addition, too many cracks will form, and the physical properties of the fibers will not be good. On the other hand, if the count of false twists of the fibers is less than 2000 twists/m, the fibers will be poorly false-twisted and the quality of the fibers will not be good. The optimum draw ratio of the fibers varies, depending on the heater temperature, and therefore can not be exactly defined. In general, however, it is desirable that the draw ratio of the fibers falls between 60 and 80% of the elongation at break of the fibers at room temperature. If the draw ratio of the fibers is higher than 80% of the elongation at break, too many cracks will form, and the physical properties of the fibers will be not good. On the other hand, if the draw ratio of the fibers is lower than 60% of the elongation at break, the false-twisting tension of the fibers will be low, and the fibers will often break. As a result, the processability of the fibers in the false-twisting step will be poor. Cracks in the fibers result from the tension and the twisting force applied while the fibers are processed in the false-twisting step, and the number of cracks formed is readily controlled to fall between 5 and 50 cracks/10 cm, as long as the tension and the twisting force of the fibers in this step do not overstep the uppermost limit. Especially preferably, the false-twisting of the fibers is carried out under conditions in which the temperature falls between 130 and 150° C., the count of false twists of the fibers falls between 2300 and 2400 twists/m in fibers of 165 dtex, and the draw ratio of the fibers falls between 70 and 75% of the elongation at break.

A fiber-processing agent may adhere to the biodegradable fibers of the invention.

The fiber-processing agent that may adhere to the fibers preferably has a pH which is lower than 7.8 in every final step of spinning, weaving or knitting, coloring and sewing the fibers and their fabrics. More preferably, the pH of the fiber-processing agent falls between 4.0 and less than 7.8. When a fiber-processing agent having a pH of less than 7.8 is applied to the fibers of the present invention, the biodegradability of the fibers is retarded and the strength maintained at a high level, thereby rending the fibers suitable for practical use. However, a fiber-processing agent having a pH which is 7.8 or greater promotes the biodegradation of the fibers. Therefore, if the agent is applied to the fibers, its action on the fibers must be blocked until the fibers, after use, are disposed of and formed into compost. The fiber-processing agent includes, for example, spinning oil and false-twist coning oil that are applied to the fibers being spun. For fabrics of the fibers, the fiber-processing agent may be any size applied during weaving, and knitting oil applied during knitting. Other examples of the fiber-processing agent are a scouring agent, a dyeing promoter, a pH-controlling agent, an antistatic agent and a sewing improver that are applied to the fibers or their products which are dyed. The spinning oil content of the fibers is preferably at most 1.0% by weight, and the amount of the finishing agent applied to the fibers or their products which are dyed preferably falls between 0.3 and 0.5% by weight, depending on the type and the purpose of the agent.

The present inventors have further found that the degradation of the biodegradable fibers of the present invention is retarded or promoted depending on the type of fiber-processing agent applied to the fibers. Specifically, the strength of the fibers of the present invention is sufficient for ordinary practical use, but because they have cracked surfaces, when a processing agent, for example, an alkaline fiber-processing agent is applied to the use products composed of the fibers of the present invention, which are intended to be disposed of and composted, the biodegradability of the fibers is promoted. That is, the biodegradability of the fibers is controlled before and after having being treated with the processing agent. This is a quite novel technical idea.

Specifically, when the biodegradable fibers of the present invention are processed with an alkaline fiber-processing agent having a pH of 7.8 or more before they are disposed of and are formed into compost, their biodegradation is promoted. In addition, the biodegradability of the fibers may be controlled by controlling the number of the cracks in their surfaces.

The alkaline fiber-processing agent applied to the used products of the fibers which are intended for disposal and forming into compost, is not specifically defined, and it may be any and every solution or processing-agent having a pH of 7.8 or more. Preferably, the processing-agent has a pH of 8.5 or more, in order to more rapidly promote the degradation of the fibers and their products. However, a strong alkali having a pH of 10 or more will have other negative environmental qualities. Most preferably, therefore, the fiber-processing agent for promoting the degradation of the fibers is an alkaline fiber-processing agent having a pH of from 8.5 to less than 10. Still another advantage of the present invention is that the biodegradation rate of the fibers is controllable in any desired manner by suitably controlling the pH of the processing agent applied to the fibers.

Preferably, a fiber-processing agent (a) having a strength reduction-promoting constant (KR value) smaller than 1.2 is applied to the biodegradable fibers of the present invention, during or after the production of the fibers, or before or during use of the fibers. One advantage treating fibers with the fiber-processing agent (a) is that the fibers maintain their strength while in ordinary daily use.

The strength reduction-promoting constant (KR value) of the fiber-processing agent (a) is represented by formula (1), as discussed above.

Degreasing the fibers may be effected in any known manner. For example, the fibers may be treated with any polar solvent, such as an alcohol, water, or halogen-containing solvents, depending on the properties of the fiber-processing agent applied to the fibers.

The fiber-processing agent (a) applied to the fibers may include, for example, spinning oil and false-twist coning oil applied during spinning. For fabrics of the fibers, the fiber-processing agent (a) may be any type of size applied during weaving, and knitting oil applied during knitting. Other examples of the fiber-processing agent (a) are a scouring agent, a dyeing promoter, a pH-controlling agent, an anti-static agent and a sewing improver that are applied to the fibers or their products during dying.

Preferred fiber-processing agents (a), include those having a strength reduction-promoting constant (KR value) falling between 1 and less than 1.2.

One preferred example of the fiber-processing agent (a) of the present invention is a spinning oil (KE3400 produced by TAKEMOTO OIL & FAT Co., LTD.) having a strength reduction-promoting constant (KR value) of 1.14 and having a pH of 7.2. Other examples of the fiber-processing agent (a) of the present invention may be a mixture of components in any desired ratio so that the resulting compositions have a KR value which is smaller than 1.2.

Another preferred method of controlling the biodegradability of the fibers of the present invention comprises applying a fiber-processing agent (b) having a strength reduction-promoting constant (KR value) according to formula (1) of 1.2 or more to the fibers, thereby promoting the biodegradation of the fibers.

Preferred examples of the fiber-processing agent (b) are a composition formulated by mixing a potassium stearyl phosphate, a polyether, an alkyl ether, a laurylamine and a nonionic surfactant in a ratio of 50:22:13:10:5, having a strength reduction-promoting constant (KR value) of 1.30 and having a pH of 9.5; and an oil (TORICOL M75 produced by TAKEMOTO OIL & FAT Co., LTD.), having a strength reduction-promoting constant (KR value) of 1.25 and having a pH of 6.5. In addition, the fiber-processing agent (b) may be any mixture of components in any desired ratio having a KR value of 1.2 or more.

If the fibers are treated with a fiber-processing agent (a) comprising a spinning oil during production or before use, the content of the spinning oil in the fibers preferably falls between 0.2% by weight and 1.0% by weight, and the content of the finishing agent applied to the fibers or their products during dying preferably falls between approximately 0.3 and approximately 0.5% by weight, depending on the type and purpose of the agent.

A processing agent that contains at least 1% by weight of at least one biodegradation-promoting component selected from a group consisting of organic phosphate salts, unsaturated fatty acids and unsaturated alcohols is preferred for promoting the biodegradation of the fibers.

For example, polyoxyethylene phosphate salts (especially preferably, C8 to C18 polyoxyethylene phosphate salts) and phosphate amines are especially preferred for promoting the reduction in the strength of the fibers. Although they have a pH of less than 7.8, C8 to C18 unsaturated fatty acids are also preferred. Oleic acid, and C8 to C18 higher unsaturated alcohols, particularly oleyl alcohol, are especially preferred, as they promote the reduction in the strength of the fibers. The fiber-processing agent content of the fibers, e.g., the spinning oil content, preferably falls between 0.2% by weight and 10.0% by weight, and especially preferably falls between 0.3 and 8% by weight, depending on the type and purpose of the agent.

As so discussed above, an alkaline solution, such as aqueous sodium hydroxide solution having a pH of 10 or more, kills microorganisms and will have a negative impact on the global environment, and are therefore not suitable for use in the present invention. For example, even if used fibers and their products are buried in ground into which sugar-containing water or the like has been infiltrated in order to promote the growth of microorganisms, biodegradation of fibers so treated may not be promoted.

FIG. 1 and FIG. 2 show the fiber morphology of the biodegradable fibers of the present invention before and after processing with an alkaline solution, respectively. Before processing with an alkaline solution, the fibers keep their original fiber morphology even though they have cracks in their surface. However, after the fibers are processed with an alkaline solution, the processing agent penetrates into the center part of the cross section of each fiber through the cracks and significantly promotes the degradation of the fibers.

The strength retention of the fibers is preferably at most 50% after the fibers are left in the ground for 4 weeks. The level of strength retention depends on the number of the cracks formed in the surfaces of the fibers, and on the type and the amount of the processing agent to be applied to the fibers.

It is desirable that the fiber-processing agent (b) is applied to the fibers or their products under as high a tension as is possible, preferably under a tension of at least 1 g/cm$^2$, more preferably at least 5 g/cm$^2$, even more preferably at least 15 g/cm$^2$. Also preferably, the amount of the fiber-processing agent (b) applied to the fibers or their products under high tension falls between 1 and 20% by weight, more preferably between 3 and 12% by weight of the fibers or their products. If the amount applied is smaller than 1% by weight, the biodegradation-promoting fiber-processing agent will be ineffective. If larger than 20% by weight, too much of the fiber-processing agent will cause pollution of the global environment, and will increase the cost of treating the used fibers.

The test results of our studies, in which 10% by weight of a fiber-processing agent (b) having a strength reduction-promoting constant (KR value) of 1.25 was applied to the fibers of the present invention, having 10 cracks/10 cm in their surfaces, under a low tension of 0.01 g/dtex, and 3% by weight of the same fiber-processing agent (b) was applied to the same fibers under a high tension of 0.15 g/dtex, confirm that the reduction in the strength of the fibers processed with the smaller amount of the agent under higher tension, is large. This is because the cracks in the surfaces of the fibers processed with the agent under higher tension are broadened and facilitate the penetration of the agent into the depths of each fiber.

The strength of the biodegradable fibers, and fabrics of the fibers, is comparable to that of ordinary fibers. The fibers and fabrics of the present invention have many applications, for example, in construction materials in agriculture and in civil engineering. After disposal, the biodegradable fibers of the present invention may be biodegraded even though no processing agent is applied. However, when a processing agent is applied, the biodegradation of the fibers is accelerated remarkably, and is easily controlled. After treatment with a processing agent, the fibers may be completely degraded within a few months, and therefore have good ecological and environmental qualities.

EXAMPLES

The present invention is described in detail with reference to the following Examples, which, however, are not intended to restrict the scope of the invention. The physical properties of the samples produced in the Examples are measured according to the methods mentioned below.

1. Specific Gravity:

A density gradient solution of a sample in a mixed solvent of n-hexane/carbon tetrachloride is put into a density gradient tube (produced by Shibayama Scientific Co., LTD.), and kept there for 24 hours. The specific gravity of the sample is measured at 25° C.+/−0.1° C.

2. Strength, Elongation:

Measured according to JIS L1013.

3. Number of Cracks:

An enlarged photograph of the fibers is taken with a scanning electronic microscope (SEM). The number of the cracks seen in the surface of each fiber in the photograph is counted.

When exposed to electromagnetic radiation for 20 seconds or longer, polylactic acid fibers tend to crack in their surfaces. Therefore, the measurement according to the method must be carried out rapidly.

Example 1

A poly-L-lactic acid polymer (6200 D grade, Cargil-Dow LLC), having a number-average molecular weight of 78,200 and an optical purity of 98.7%, was spun into non-stretched polylactic acid fibers of 4500 dtex/704 f. The spinning head temperature was 240° C., the wind-up rate was 800 m/min, and 0.2% by weight of spinning oil (KE3400, TAKEMOTO OIL & FAT Co., LTD.) having a strength reduction-promoting constant (KR value) of 1.14 and having a pH of 7.2 was applied to the fibers during spinning. The specific gravity of the non-stretched fibers was 1.3105, and the elongation at break was 330%.

The non-stretched fibers were bundled up into non-stretched tow of 516,000 dtex. The tow was then drawn in two stages. Specifically, the water bath temperature in the first drawing stage was 70° C., the water bath temperature in the second drawing stage was 95° C., the draw ratio in the first drawing stage was 3.50 times, the draw ratio in the second drawing stage was 1.23 times, and the total draw ratio was 4.30 times (100% of the elongation at break). 0.3% by weight of KE3400, having a strength reduction-promoting constant (KR value) of 1.14 and having a pH of 7.2 was applied to the stretched tow, which was then crimped. The forced crimper had an inlet pressure of 3.0 kg/cm$^2$ and an outlet pressure of 2.5 kg/cm$^2$ and the crimping rate was 80 m/min. Thus crimped, the number of buckles of the tow was 14 or 15 per 2.5 cm. The crimped tow was cut with a cutter into 38-mm pieces, polylactic acid short fibers having a single fiber fineness of 1.5 dtex. The number of the cracks formed in the surfaces of the stretched short fibers was 48 per 10 cm of each single fiber, the specific gravity of the short fibers was 1.2323, the strength at break was 3.1 cN/dtex, and the elongation at break thereof was 30.5%. Based on their strength and elongation properties, these short fibers are suitable for practical use.

The short fibers were spun in a conventional manner into yarn of 10 tex.

The spun yarn was woven into victoria lawn of 12×12 yarns/25 mm. The victoria lawn was filled with polyvinyl alcohol size having a pH of 6.3 and at a concentration of 10%, at 75° C., and then dried at 155° C.

The spun yarn was dissolved and hydrolyzed in an aqueous 1 N alkaline solution at 50° C. for 15 minutes, thereby forming voids inside the fibers of the yarn. As in the cross-sections of the fibers of processed yarn shown in FIG. 2, the outer skin (outer part) of each fiber remained essentially intact, but the inside (inner part) of the fiber was eroded to form voids. The single fibers in which the voids formed account for about 90% of the total number of the filaments, and about 55% on average of the cross-sectional area of each fiber is comprised of the voids.

The victoria lawn produced herein was buried in the ground. Before and after being buried, the strength retention of the yarn was measured. The weft of the sample was cut off, and the strength of the warp alone was measured.

If the Victoria lawn was not processed with the fiber-processing agent discussed below, the strength retention of the sample was 96.9% after 4 weeks. In contrast, the strength retention of a sample that had been sprayed with 5%, relative to the weight of the sample cloth, of a fiber-processing agent consisting of a biodegradation promoter composition formulated by mixing a potassium stearyl phosphate, a polyether, an alkyl ether, a laurylamine and a nonionic surfactant in a ratio of 50:22:13:10:5, having a strength reduction-promoting constant (KR value) of 1.30 and having a pH of 9.5, was significantly reduced to a level of 42.8% after 4 weeks.

Example 2

Non-stretched fibers prepared in the same manner as in Example 1 were bundled up into non-stretched tow of 456,000 dtex. The tow was then drawn in two stages. The water bath temperature in the first drawing stage was 65° C., the water bath temperature in the second drawing stage was 95° C., the draw ratio in the first drawing stage was 3.30 times, the draw ratio in the second drawing stage was 1.15 times, and the total draw ratio was 3.80 times (88% of the elongation at break). 0.3% by weight of spinning oil (KE3400, TAKEMOTO OIL & FAT Co., LTD.) having a strength reduction-promoting constant (KR value) of 1.14 and having a pH of 7.2 was applied to the stretched tow, which was then crimped. The forced crimper had an inlet pressure of 3.0 kg/cm$^2$ and an outlet pressure of 2.5 kg/cm$^2$ and a crimping rate of 80 m/min. Thus crimped, the number of buckles of the tow was 14 or 15/2.5 cm. The thus-crimped tow was cut with a cutter into 38-mm pieces of polylactic acid short fibers having a single fiber fineness of 1.7 dtex. The number of the cracks formed in the surfaces of the stretched short fibers was 9 per 10 cm of each single fiber, the specific gravity of the short fibers was 1.2381, the strength at break was 2.9 cN/dtex, and the elongation at break was 30.3%. Based on their strength and elongation, the short fibers are suitable for practical use.

The short fibers were spun in an ordinary manner into yarn of 10 tex.

The spun yarn was woven into victoria lawn of 12×12 yarns/25 mm. The victoria lawn was filled with a polyvinyl alcohol size having a pH of 6.3 and a concentration of 10% at 75° C., and then dried at 155° C.

The spun yarn was dissolved and hydrolyzed in an aqueous 1 N alkaline solution at 50° C. for 15 minutes, thereby forming voids in the fibers comprising the yarn. As in the cross-section of fibers shown in FIG. 2, the fibers of the processed yarn had an outer skin (outer part) of each fiber which remained essentially intact, but voids formed in the inside (inner part). The single fibers in which the voids formed account for about 93% of the total number of the filaments, and about 65% on average of the cross-sectional area of each fiber are voids.

The victoria lawn produced thereby was buried in the ground. Before and after being buried, the strength retention of the yarn was measured. The weft of the sample was cut off, and the strength of the warp alone was measured.

If the Victoria lawn was not processed with the fiber-processing agent mentioned below, the strength retention of the sample was 94.4% after 4 weeks. In contrast, the strength retention of the sample that had been sprayed with 5%, relative to the weight of the sample cloth, of a fiber-processing agent comprising a biodegradation promoter oil (TORICOL M75, TAKEMOTO OIL & FAT Co., LTD.) having a strength reduction-promoting constant (KR value) of 1.25, was significantly reduced to a level of 50.1% after 4 weeks.

Example 3

A poly-L-lactic acid polymer (6200 D grade, Cargill-Dow LLC), having a number-average molecular weight of 74,000 and an optical purity of 98.6%, was spun into stretched polylactic acid fibers of 278 dtex/48 f. The spinning head temperature was 205° C., the first roller temperature was 50° C., the second roller temperature was 90° C., the third roller temperature was 90° C., the fourth roller temperature was 140° C., the cooling roller temperature was 50° C., the pre-stretching draw ratio was 1.01 times, the first stretching draw ratio was 1.73 times, the total draw ratio was 2.32 times (90% of the elongation at break at room temperature), the wind-up rate was 3565 m/min, and 0.8% by weight of spinning oil (KE3400 produced by TAKEMOTO OIL & FAT Co., LTD.) having a pH of 7.2 was applied to the polymer during spinning. The elongation at break of the stretched fibers was 37.5%.

A two-folded yarn of the stretched fibers was false-twisted, using a friction false-twisting machine. The draw ratio was 1.05 times, the heater temperature was 140° C., D/Y was 756, and the yarn running speed was 200 m/min. Every single fiber of the false-twisted yarn had 25 cracks/10 cm, the strength of the yarn was 2.1 cN/dtex, and the elongation at break was 28.7%.

The processed yarn was Z-twisted to a count of 300 twists/m. Using a rapier loom (produced by Tsudakoma Corp.), the twisted yarn was woven into a plain weave fabric having an on-loom density of 63×45 yarns/25 mm.

The fabric was then dyed as follows. The fabric was scoured in hot water containing no alkali at 80° C., dried, pre-set, dyed (white), dried and then finally set.

Thus processed, the final density of the fabric was 73×50 yarns/25 mm.

The processed yarn was dissolved and hydrolyzed in an aqueous 1 N alkaline solution at 50° C. for 15 minutes. As a result, the fibers constituting the yarn had voids formed inside them. As in FIG. 2, the cross-sections of the fibers of the processed yarn show that the fibers had an outer skin (outer part) which remained essentially intact, but the inside (inner part) of each fiber contained voids. The single fibers in which the voids formed account for about 90% of the total number of the filaments and 50% on average of the cross-sectional area of each fiber are voids.

The fabric produced as described above was buried in the ground. Before and after being buried, the strength retention of the yarn was measured. The fibers were carefully extracted out of the fabric, and their strength was measured.

Fibers which were not processed with the alkaline fiber-processing agent mentioned below had a strength retention of 89.2% after 4 weeks. In contrast, the strength retention of the sample that had been sprayed with 5%, relative to the weight of the sample cloth, of an alkaline fiber-processing agent consisting essentially of potassium stearyl phosphate and having a pH of 9.5, was significantly reduced to 47.6% after 4 weeks.

Comparative Example 1

The non-stretched polylactic acid fibers prepared in Example 1 were bundled up into non-stretched tow of 372,000 dtex. The tow was stretched in two stages. The water bath temperature in the first stage was 65° C., the water bath temperature in the second stage was 95° C., the draw ratio in the first stage was 2.50 times, the draw ratio in the second stage was 1.24 times, and the total draw ratio was 3.10 times (72% of elongation at break). Next, 0.3% by weight of finishing oil (KE3400, TAKEMOTO OIL & FAT Co., LTD.) having a strength reduction-promoting constant (KR value) of 1.14 and having a pH of 7.2 was applied to the stretched tow, which was then crimped. The forced crimper had an inlet pressure of 1.9 kg/cm$^2$ and an outlet pressure of 1.9 kg/cm$^2$. Thus crimped, the number of buckles of the tow was 14 or 15 per 2.5 cm. The crimped tow was cut with a cutter into 38-mm pieces of polylactic acid short fibers having a single fiber fineness of 2.0 dtex. The number of the cracks formed in the surfaces of the stretched short fibers was 2 per 10 cm of each single fiber, the specific gravity of the short fibers was 1.2460, the strength at break was 2.3 cN/dtex, and the elongation at break was 52.3%.

The short fibers were spun in an ordinary manner into yarn of 10 tex.

The spun yarn was woven into victoria lawn of 12×12 yarns/25 mm, in the same manner as in Example 1. The victoria lawn was filled with a polyvinyl alcohol size having a pH of 6.3 and a concentration of 10% at 75° C., and then dried at 155° C., also in the same manner as in Example 1.

The spun yarn was dissolved and hydrolyzed in an aqueous 1 N alkaline solution at 50° C. for 15 minutes. The processed fibers comprising the yarn had only a few voids formed inside them. Specifically, the single fibers in which the voids formed account for about 50% of the total number of the filaments and about 3% on average of the cross-sectional area of each fiber. The inside (inner part) of each fiber essentially did not have voids.

The victoria lawn produced as discussed above was buried in the ground. Before and after being buried, the strength retention of the yarn was measured. The weft of the sample was cut off, and the strength of the warp alone was measured.

Samples which were not processed with the fiber-processing agent mentioned below, had a strength retention of 105.8% after 4 weeks. On the other hand, the strength retention of samples that had been sprayed with 5%, relative to the weight of the sample cloth, of a fiber-processing agent comprising a biodegradation promoter composition prepared by mixing a potassium stearyl phosphate, a polyether, an alkyl ether, a laurylamine and a nonionic surfactant in a ratio of 50:22:13:10:5, having a strength reduction-promoting constant (KR value) of 1.30 and having a pH of 9.5, was still 80.2% after 4 weeks.

Comparative Example 2

Raw spun fibers prepared in the same manner as in Example 1 were bundled up into non-stretched tow of 120,000 dtex. The tow was stretched in two stages. The water bath temperature in the first stage was 60° C., the water bath temperature in the second stage was 95° C., the draw ratio in the first stage was 3.60 times, the draw ratio in the second stage was 1.23 times, and the total draw ratio was 4.43 times (103% of elongation at break. Next, 0.3% by weight of spinning oil (KE3400, TAKEMOTO OIL & FAT Co., LTD.) having a strength reduction-promoting constant (KR value) of 1.14 and having a pH of 7.2 was applied to the stretched tow, which was then crimped. The forced crimper had an inlet pressure of 5.6 kg/cm and an outlet pressure of 6.5 kg/cm$^2$. Thus crimped, the number of buckles of the tow was 14 or 15 per 2.5 cm. The crimped tow was cut with a cutter into 38-mm pieces of polylactic acid short fibers having a single fiber fineness of 1.5 dtex. The number of cracks formed in the surfaces of the stretched short fibers was 64 per 10 cm of each single fiber, the specific gravity of the short fibers was 1.2109, and the strength at break was 1.3 cN/dtex. The strength of the fibers was too low for practical use.

Comparative Example 3

A poly-L-lactic acid polymer having a number-average molecular weight of 47,200 and an optical purity of 98.7%, was spun at a spinning head temperature of 200° C. and a winding-up rate of 800 m/min. Although the polymer cobwebbed to some degree, the strength of the polymer was too low, and it was impossible to wind up the polymer fibers.

As described in detail above, with particular reference to the preferred embodiments, the present invention provides biodegradable fibers having the physical properties which are good enough for ordinary daily use and which provide for controlled biodegradation.

The priority document of the present application, Japanese application 348141/2001, filed Nov. 14, 2001, is incorporated herein by reference.

Obviously, numerous modifications and variations on the present invention are possible in light of the above teachings. It is therefore to be understood that within the scope of the appended claims, the invention may be practiced otherwise than as specifically described herein.

What is claimed as new and is intended to be secured by Letters Patent is:

1. Biodegradable polylactic acid fibers comprising a polylactic acid polymer having a number-average molecular weight of from 50,000 to 150,000, wherein the alkali solubility of an interior portion of each fiber is greater than the alkali solubility of the outer, peripheral portion of the fiber, and the surface of each fiber has from 5 to 50 cracks/10 cm.

2. The biodegradable fibers of claim 1, treated with a fiber-processing agent having a pH of less than 7.8.

3. The biodegradable fibers of claim 1, treated with a fiber-processing agent (a) having a strength reduction-promoting constant (KR value) represented by the following formula (1) of less than 1.2:

$$\text{Strength Reduction-promoting Constant}(KR\text{ value})=TA/TB \quad (1)$$

wherein TA is the strength of the biodegradable fibers measured after the fibers are degreased and maintained at a temperature of 50° C. and a humidity of 65% for 7 days; and TB is the strength of the biodegradable fibers measured after the fibers are degreased, then treated with from 1 to 5% by weight of a fiber-processing agent (a) while the fibers are subjected to a tension of from 0.05 to 0.20 g/dtex, then maintaining the treated fibers at a temperature of 50° C. and a humidity of 65% for 7 days.

4. A fabric comprising the biodegradable fibers of claim 1.

5. A method for controlling the biodegradation of the biodegradable fibers of claim 1 comprising:

treating the surfaces of the fibers with an alkaline fiber-processing agent having a pH of not lower than 7.8.

6. A method for controlling the biodegradation of the biodegradable fibers of claim 1, comprising:

treating the fibers with a fiber-processing agent (b) having a strength reduction-promoting constant (KR value) represented by the following formula (1) of 1.2 or more:

$$\text{Strength Reduction-promoting Constant}(KR\text{ value})=TA/TB \quad (1)$$

wherein TA is the strength of the biodegradable fibers measured after the fibers are degreased and then maintained at a temperature of 50° C. and a humidity of 65% for 7 days; and TB is the strength of the biodegradable fibers measured after the fibers are degreased, then treated with from 1 to 5% by weight of a fiber-processing agent (b) while the fibers are subjected to a tension of from 0.05 to 0.20 g/dtex, then maintaining the treated fibers at a temperature of 50° C. and a humidity of 65% for 7 days.

7. A method controlling the biodegradation of the biodegradable fibers of claim 1 comprising:

treating the fibers with a fiber-processing agent comprising at least 1% by weight of at least one component selected from the group consisting of organic phosphate salts, unsaturated fatty acids and unsaturated alcohols.

8. The biodegradable fibers of claim 1, wherein the number-average molecular weight of the polylactic acid is from 70,000 to 110,000.

9. The biodegradable fibers of claim 1, wherein the polylactic acid comprises poly-L-lactic acid having an optical purity of from 90.0 to 99.5%.

10. The biodegradable fibers of claim 1, wherein the cracks comprise cracks extend in the direction of the fiber axis, and the cracks extending in the direction of the fiber axis have a length of between 1/20 and 3 times the fiber diameter.

11. The biodegradable fibers of claim 1, wherein the cracks have a depth of 3 to 30% of the fiber diameter.

12. The biodegradable fibers of claim 1, wherein the exterior portion of the fiber has a thickness of from 5 to 20% of the mean diameter of the fiber.

13. A method of preparing the biodegradable fibers of claim 1, wherein the fibers are prepared by a process comprising:

spinning the fibers, drawing the fibers at a temperature from 50 to 140° C. to a draw ratio of 85 to 120% of the elongation at break of the fibers measured at 25° C., and applying an external force to the drawn fibers, thereby forming cracks.

14. A method for controlling the biodegradation of the biodegradable fibers of claim 2 comprising:

treating the surfaces of the fibers with an alkaline fiber-processing agent having a pH of not lower than 7.8.

15. A method for controlling the biodegradation of the biodegradable fibers of claim 2, comprising:

treating the fibers with a fiber-processing agent (b) having a strength reduction-promoting constant (KR value) represented by the following formula (1) of 1.2 or more:

$$\text{Strength Reduction-promoting Constant}(KR\ \text{value}) = TA/TB \quad (1)$$

wherein TA is the strength of the biodegradable fibers measured after the fibers are degreased and then maintained at a temperature of 50° C. and a humidity of 65% for 7 days; and TB is the strength of the biodegradable fibers measured after the fibers are degreased, then treated with from 1 to 5% by weight of a fiber-processing agent (b) while the fibers are subjected to a tension of from 0.05 to 0.20 g/dtex, then maintaining the treated fibers at a temperature of 50° C. and a humidity of 65% for 7 days.

16. A method controlling the biodegradation of the biodegradable fibers of claim 2 comprising:

treating the fibers with a fiber-processing agent comprising at least 1% by weight of at least one component selected from the group consisting of organic phosphate salts, unsaturated fatty acids and unsaturated alcohols.

17. A fabric comprising the biodegradable fibers of claim 2.

18. A yarn comprising the biodegradable fibers of claim 1.

19. A yarn comprising the biodegradable fibers of claim 2.

* * * * *